United States Patent [19]

Buxmann et al.

[11] 4,174,826

[45] Nov. 20, 1979

[54] APPARATUS FOR LOWERING THE CONCENTRATION OF SODIUM IN ALUMINUM MELTS

[75] Inventors: Kurt Buxmann; Jean-Daniel Bornand, both of Sierre; Alfred Steinegger, Venthône, all of Switzerland

[73] Assignee: Swiss Aluminium Ltd., Chippis, Switzerland

[21] Appl. No.: 951,214

[22] Filed: Oct. 13, 1978

Related U.S. Application Data

[62] Division of Ser. No. 780,225, Mar. 22, 1977, Pat. No. 4,138,246.

[30] Foreign Application Priority Data

Mar. 26, 1976 [CH] Switzerland ..... 3807/76

[51] Int. Cl.[2] ..... C22B 9/02

[52] U.S. Cl. ..... 266/227; 210/69

[58] Field of Search ..... 266/227; 75/68 R; 210/69

[56] References Cited

U.S. PATENT DOCUMENTS

| | | | |
|---|---|---|---|
| 3,528,801 | 9/1970 | Bylund et al. | 75/68 R |
| 3,917,242 | 11/1975 | Bass et al. | 266/227 X |

*Primary Examiner*—M. J. Andrews

*Attorney, Agent, or Firm*—Bachman and LaPointe

[57] ABSTRACT

The sodium content of aluminum melt is reduced efficiently to within acceptable limits by filtering the primary metal from the electrolytic cell through a loosely packed filter bed of granular material which in part comprises carbon. The treatment is carried out before alloy additions are made, and the temperature of the melt before entering the filter is higher than 780° C.

9 Claims, 6 Drawing Figures

APPARATUS FOR LOWERING THE CONCENTRATION OF SODIUM IN ALUMINUM MELTS

This is a division of application Ser. No. 780,225, filed Mar. 22, 1977 now U.S. Pat. No. 4,138,246.

The invention concerns a process for lowering the concentration of sodium in aluminum melts flowing through a filter bed of granular material.

Liquid aluminum which has just been taken from the electrolytic cell contains impurities of alkali metals and alkali earth metals. As it is supplied to the foundries this metal contains 30–80 ppm of sodium. In highly alloyed alloys, in particular in AlMg alloys, sodium causes such impurities to be harmful in that they increase the susceptibility to cracking during hot forming. It is necessary therefore with such alloys to take suitable measures to lower the sodium content to concentrations of less than 10 ppm in normal cases and even to less than 3 ppm in special cases. Furthermore, even small, trace amounts of sodium increase the rate of surface oxidation in aluminum melts (W. Thiele, Aluminium 38, 1962, 712). The result is that, since melts containing sodium give rise to greater amounts of dross on the surface, greater metal losses must be expected when sodium is present in the melt.

For a long time therefore, people have searched for methods which will eliminate sodium from aluminum melts, or which will lower its concentration to within acceptable limits. Up to now basically three approaches have evolved. These are as follows.

In the first method aluminum melts are treated with elemental chlorine which removes sodium along with other impurities in the form of chlorides. The greatest disadvantage of this process is that chlorine is poisonous. This makes its use risky from the point of view of health and also makes it a serious danger to the environment. Also, the aluminum chloride which precipitates out as a by-product in the waste gas is a further problem. It is usually changed to the hydrochloride by moisture and has to be removed from the waste gas. The result is that expensive protective measures have to be taken and expensive electrostatic filters have to be employed to purify the waste gas.

More recently attempts have been made to treat the melts with gas mixtures containing lower concentrations of poisonous gases such as $Cl_2$. Mixtures of chlorine, carbon monoxide, nitrogen and possibly chlorofluoro-hydrocarbons have in particular been used for this purpose. Such gas mixtures however, although adequate for most other aspects of melt treatment, are not as effective as chlorine at removing sodium. Also, it is necessary to install relatively expensive facilities for mixing the gases in order to be able to use them.

All the treatments which involve bubbling a gas through the melt suffer from the disadvantage that they promote the formation of dross on the surface of the melt, which in turn increases metal losses. 2–10 kg of dross per ton of metal may be formed, the amount depending on the type of gas used and the length of treatment. Pure chlorine and organic additives to inert gases have a particularly strong tendency to form dross.

Such gas treatment has a further disadvantage in that, after it has been carried out the melt can take up sodium again. The reason is that on adding metal from the electrolytic cell to the furnace, small amounts of cryolite can be carried over accidentally, and, as soon as magnesium is added, the melt again takes up sodium. It is difficult to check this kind of contamination process and so it is an uncertainty which makes itself felt by fluctuations in metal quality.

A second method which is currently used to purify aluminum melts is the use of mixtures of sodium-free salts. This process is intended primarily for removing solid oxide particles from the melt but it is, within limits, also suitable for removing metallic impurities which, like sodium, are liquid at the temperature of the aluminum melt. Apart from the fact that up to now it has not been shown systematically that this method is actually able to lower the sodium content reliably to levels below the required limit, the quantities of salt used for this purpose represent a considerably large expenditure in production. There are, furthermore, problems which arise in connection with the disposal of the residue produced by this method.

A third method which is currently used for lowering the sodium content is to filter the aluminum melt through a loosely packed layer of granular material. In a two furnace system in which the metal from the electrolytic cell is poured into a mixing furnace (where the alloy additions are made to the melt before it is transferred to a holding furnace), such a filter is normally positioned between the mixing furnace and the holding furnace. If the mixing furnace also serves as the holding furnace then the filter is positioned in line immediately next to the casting unit. In both cases operating conditions dictate that the temperature of the filter lies between 700° C. and 750° C. Also the metal is consequently always filtered after alloying additions have been made. It has been shown by experience that by choosing suitable material for the filter bed (carbon in some form or other) the sodium content can be lowered to about half of its original value.

This method of filtration suffers from a number of important disadvantages which considerably diminish its suitability for removing sodium. First of all the efficiency of the method (sodium content reduced by about 50%) is not always adequate to meet the given quality limits in a single stage. By repeating the filtering often enough it is indeed possible to reduce the sodium concentration to the required lower limit. However the high energy costs involved in reheating make this unsuitable for production.

A second disadvantage with this method is that the impurities have to be removed from melts to which the alloying elements have already been added. The removal of sodium from alloys is from experience basically more difficult than from pure aluminum and can, depending on the chemical composition of the alloy, give rise to considerable additional problems. It is for example much more difficult to remove alkali metals from alloys with a high magnesium content (e.g. 3.7–4.3% Mg and 0.3–0.7% Mn) than from comparable alloys which have a low magnesium content.

In addition to these disadvantages which accompany the present, modern methods for purifying aluminum melts there is another problem which occurs everywhere that large tonnages of liquid aluminum have to be handled. This is simply that, besides the cost of salaries, the most important items of expenditure involved in running an aluminum foundry at the fixed costs and the energy costs which are covered by the so called "liquid metal lifetime". By this is meant the interval of time during which a molten charge remains in the liquid state i.e. from the moment it is taken from the electrolytic cell until it solidifies in the casting unit. Depending on how the plant is organized, conventional methods result in a liquid metal lifetime of up to 12 hours, in particular if an additional holding treatment is required. The methods of melt filtration described above increase the liquid metal lifetime and in general affect costs adversely.

If furnace capacity is limited, efforts are made to employ methods of melt treatment which require the shortest possible time, in particular methods which perform several process steps simultaneously.

The change in sodium concentration, during such a process which gives rise to relatively long liquid metal lifetimes, is shown in the example in FIG. 4, whereby the individual steps of the process are denoted by the following numbers: I—pouring the metal into the mixing furnace, II—removing the dross, III—making alloy additions, stirring, grain refining, V—removing dross, VI—holding, VII—filtering, VIII—casting. The sodium concentration in the melt is indicate in the upper part of the figure in which the unshaded columns indicate in each case the sodium concentration before the particular stage of the process and the shaded regions the concentration after that stage.

With this process, maintaining the melt for a long time at 720°-740° C. can be particularly uneconomical since the energy costs involved are disproportionately large.

A further disadvantage of the melt methods currently in use is the large metal loss due to oxidation of the surface by the oxygen in the air. This is due in part to the fact that in transferring the liquid metal from the electrolytic cell, the metal is poured through the air from the pot line collecting crucible into the mixing furnace. The result is that a large melt surface, which oxidizes relatively easily, is exposed to the air. Consequently the mixing furnace contains a mixture of melt and oxide, which means that the melt must be allowed to stand in the furnace for a certain length of time until the oxide has collected on the surface and is able to be skimmed off. Furthermore, it is known that the oxidation behavior of pure aluminum is significantly affected by the addition of sodium and other alkali and alkali earth metals. If an aluminum melt at a given temperature is exposed to the air, and the extent of oxidation followed by noting the increase in weight as a function of the time exposed, then the plot shown in FIG. 3 is obtained. This then shows the strong dependence on the quantity and kind of addition which is made (Data taken from W. Thiele, Aluminum 38, 1962, 712, 714, modified). The great difference between the o xidation behavior of pure aluminum and that of aluminum containing sodium as impurity, indicates that a strong reaction must have taken place in the latter and that the sodium participates in the oxidation process. In the case of sodium, which has a boiling point of 883° C., this can be explained in part by the vaporization of sodium at the given temperature breaking up the continuous, protective $Al_2O_3$ film on the surface of the sample. The oxygen in the air then has access to the aluminum and oxidizes it. It is therefore to be expected that the lower the sodium content of the melt the less dross will be formed and likewise the smaller will be the metal losses.

The object of the invention presented here was to improve the efficiency of the process by which the sodium concentration in aluminum melts is lowered and in doing so to avoid the uneconomic, long liquid metal lifetime. This objective is achieved by way of the process of the invention in that the melt, immediately on being taken from the pot line crucible, is passed through a bed of granular material which consists at least in part of carbon, and the temperature of the aluminum is more than 780° C. before entering the granular bed. It has been found, surprisingly, that through this combination of filtering a purer starting material than the normal, increasing the temperature of the process, and using carbon with a set purpose, the sodium concentration in an aluminum melt can be reduced to less than 1 ppm in a single step and if the sodium concentration at the start is more than 100 ppm, it can be reduced to at least a tenth of the initial concentration.

This has been observed with all pouring temperatures over 780° C. regardless of whether the melt is flushed with an inert gas or not (table 1).

Although a certain temperature effect can be observed even when using a filter bed which does not contain carbon, it is clear that only the combination of filter beds containing carbon, a higher temperature and a starting material which is already lower in sodium on coming from the electrolytic cell leads to a large improvement in the efficiency of the process.

Besides the unexpectedly large increase in efficiency, the process of the invention for removing sodium directly from the primary pot line metal offers the advantage that the metal losses due to oxidation of the surface by oxygen in the air are considerably reduced. The reason for this is that the resistance to flow of the melt during continuous filtering causes the melt to enter the furnace relatively slowly and without any turbulance near the surface of the charge.

| Alloy | Filter Material | Gas Treatment | Metal-Temperature °C. on entry | Metal-Temperature °C. at exit | Na-Concentration ppm) on entry | Na-Concentration ppm) at exit |
|---|---|---|---|---|---|---|
| AlMg3 | 75% Coke | Ar | 720 | 700 | 16 | 9 |
| " | 25% Pitch | 0.3 $Nm^3/h$ | 740 | 705 | 25 | 14 |
| Al 99.5 | 75% Coke | Ar | 885 | 870 | 53 | <1 |
| | 25% Pitch | 0.3 $Nm^3/h$ | | | | |
| " | 75% Coke | Ar | 840 | 820 | 61 | 1 |
| | 25% Pitch | 0.3 $Nm^3/h$ | | | | |
| " | 75% Coke | Ar | 820 | 790 | 28 | 1 |
| | 25% Pitch | 0.3 $Nm^3/h$ | | | | |
| " | 75% Coke | Ar | 785 | 770 | 27 | <1 |
| | 25% Pitch | 0.3 $Nm^3/h$ | | | | |
| " | 75% Coke | Ar | 750 | 740 | 11 | <1 |
| | 25% Pitch | 0.3 $Nm^3/h$ | | | | |
| " | None | Ar | 800 | 785 | 22 | 16 |
| | | 0.3 $Nm^3/h$ | | | | |
| " | " | AR | 800 | 765 | 17 | 13 |
| | | 0.3 $Nm^3/h$ | | | | |
| " | 75% Coke | None | 785 | 780 | 15 | 1 |
| " | 25% Pitch | " | 860 | 850 | 53 | 1 |

-continued

| Alloy | Filter Material | Gas Treatment | Metal-Temperature °C. on entry | Metal-Temperature °C. at exit | Na-Concentration ppm) on entry | Na-Concentration ppm) at exit |
|---|---|---|---|---|---|---|
| " | Magnesite | Ar | 800 | 790 | 20 | 4 |
| " | " | 0.3 $Nm^3/h$ | 710 | 700 | 21 | 21 |

Table 1: Lowering the sodium concentration in aluminum under a variety of conditions with respect to alloy composition and process parameters. Rate of metal throughput through the treatment chamber with/without filter material was approx. 10 metric tons per hour. The active volume of the filter bed was 0.2 $m^3$. Sodium content measured by atomic absorption spectroscopy.

This way the process avoids the formation of a large surface area which could be oxidized by the oxygen in the air, and which would considerably increase the amount of dross formed. Also, it can be seen from the previously mentioned oxidation behavior of aluminum and its alloys (FIG. 3), that it must be to advantage to remove the sodium from the aluminum melt as early as possible in the production sequence.

Whilst the conventional melt treatment process allows sodium contamination (which favors oxidation), to exist for 3–5 hours, in the process according to the invention the sodium is practically quantitatively eliminated in the course of the first hour after withdrawal from the pot line, and thus achieves the oxidation kinetics closely corresponding to those for pure aluminum shown in FIG. 3. This way the losses due to oxidation are reduced to a third of that experienced in current melt treatment process. Whilst with chlorine gas treatment 1.3 wt % and current melt filtration methods 0.95 wt % metal loss must be reckoned with, in the process in accordance with the invention this loss amounts to only 0.3 wt %.

Besides the unexpectedly large improvement with respect to removal of sodium and the associated reduction in metal losses, the process in accordance with the invention offers the advantage of being especially economical in that the previously mentioned liquid metal lifetime is shortened thus providing savings in fixed costs and in energy expenditure, the extent of which depends on the production facilities.

Also, mention must be made of the time saved and the reduction in salary costs which results because the melt treatment for removal of sodium no longer requires a separate stage in the process, but instead is incorporated in the process of transferring pot line metal to the furnace.

A further advantage of the arrangement due to the invention is that it ensures that impurities in the melt from the pot line crucible, in particular dross and small amounts of cryolite, are not carried over into the furnace, but are held back by the filter bed. This not only reduces the work required in cleaning the furnace but also prevents subsequent up-take of sodium from the cryolite after magnesium is added to the furnace.

Figure 1:
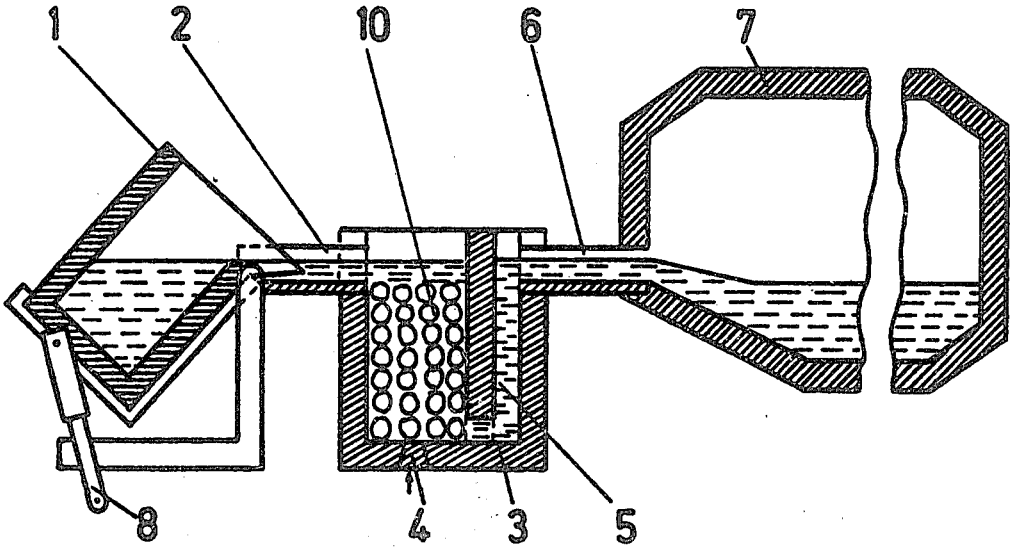
FIGS. 1 and 2 illustrate an apparatus in accordance with the present invention.
Figure 2:
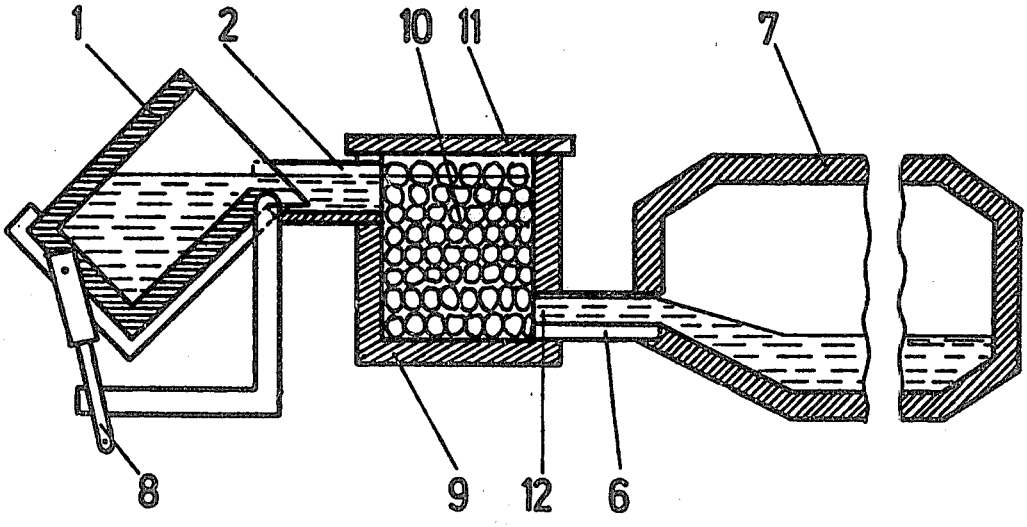
Figure 3:
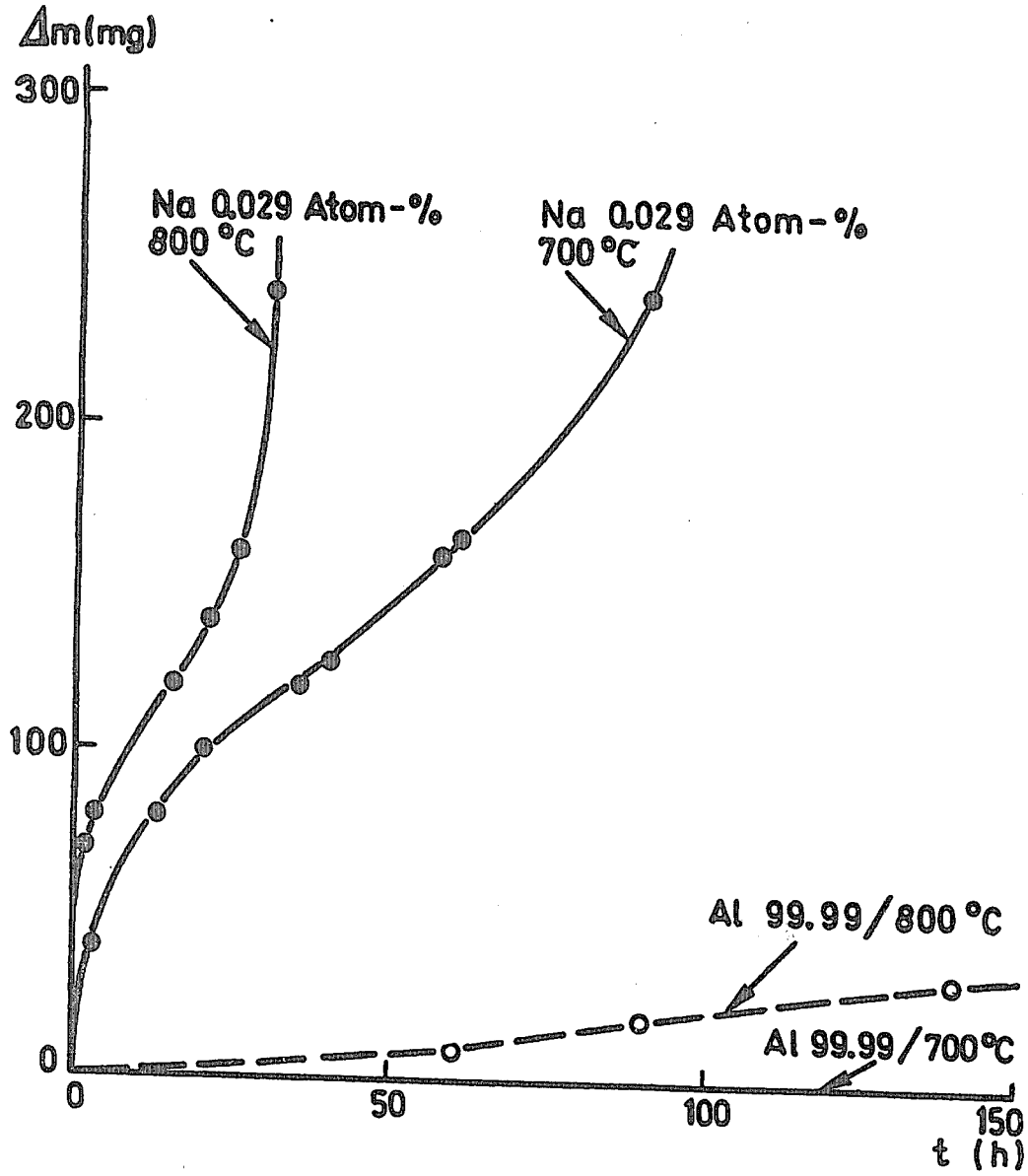
FIG. 3 illustrates the sodium quantity eliminated with respect to time.

In production the process according to the invention is made up of the individual steps shown in FIGS. 1 and 2. If a gas is bubbled through the melt as an additional treatment for the removal of sodium (FIG. 1), then the primary metal from the pot line crucible (1) is poured via a channel (2) into a continuous filter unit (3) which has two chambers one of which is filled with a loosly packed filter bed of granular material (10) containing carbon. The purified melt leaves the filter chamber via a riser chamber (5) and is led via another channel (6) into the furnace (7). An inert gas, flowing counter to the direction of flow of the melt, is introduced into the part of the filter unit containing the granulated material via a porous brick (4) of refractory material incorporated in the floor. This inert gas may be nitrogen or a mixture of noble gases. A gas mixture containing 1–3 vol % of an aliphatic chloro-fluoro-hydrocarbon has been found to be particularly good in this connection. The rate of pouring is controlled by the tilting device (8) and takes into account the permeability of the filter bed (10). There is, alternatively, the possibility of installing the filter unit (3) directly in line with a unit for casting ingots.

If the melt is not treated with an inert gas, then the riser chamber (5) is omitted and the arrangement is as shown in FIG. 2. In this case the primary metal from the electrolytic cell is poured from the pot line crucible (1) into a single chamber filter unit (9) and passed through a filter bed of a granular material (10) containing carbon. If the granular material (10) is less dense then the melt, then it must be held down by a lid which is suitable for this purpose. The melt is led into the furnace (7) via an opening (12) at the base of the filter unit (9) and a channel (6) leading from this opening (12). The granular material of the loosely packed filter bed is usefully of a material which has a higher density than that of the aluminum melt and which is coated with a layer of carbon. This material may be for example corundum, magnesite, zirconium oxide, zirconium silicate or basalt, and the carbon of petroleum coke (ethylene coke, acetylene coke), graphite, bituminous coal or coal tar pitch. The diameter of the individual granular particles may be between 1 and 20 cm.

Figure 4:
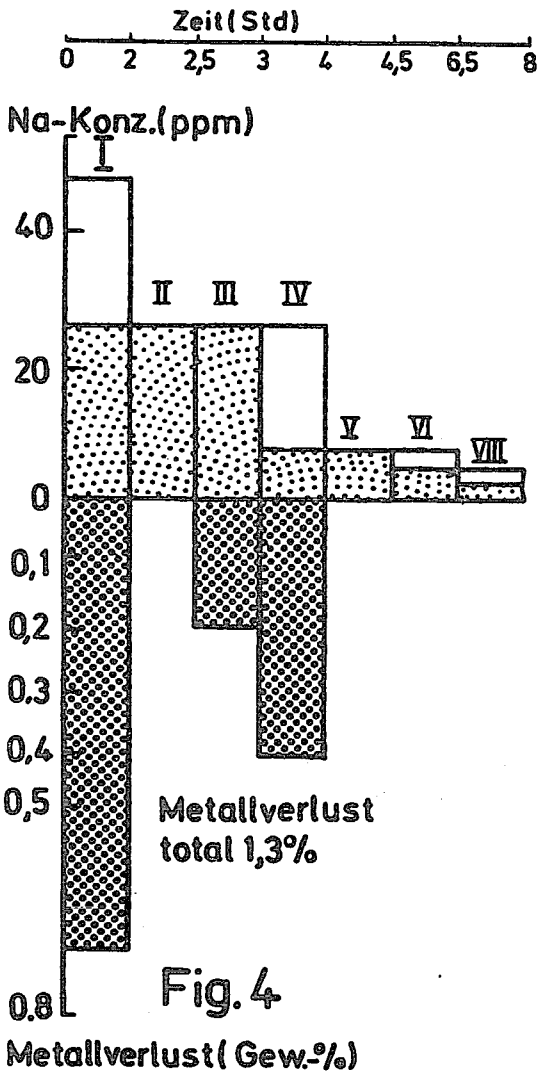
FIGS. 4 through 6 summarize the process of the present invention dealing with the removal of sodium and metal losses due to oxidation.
Figure 5:
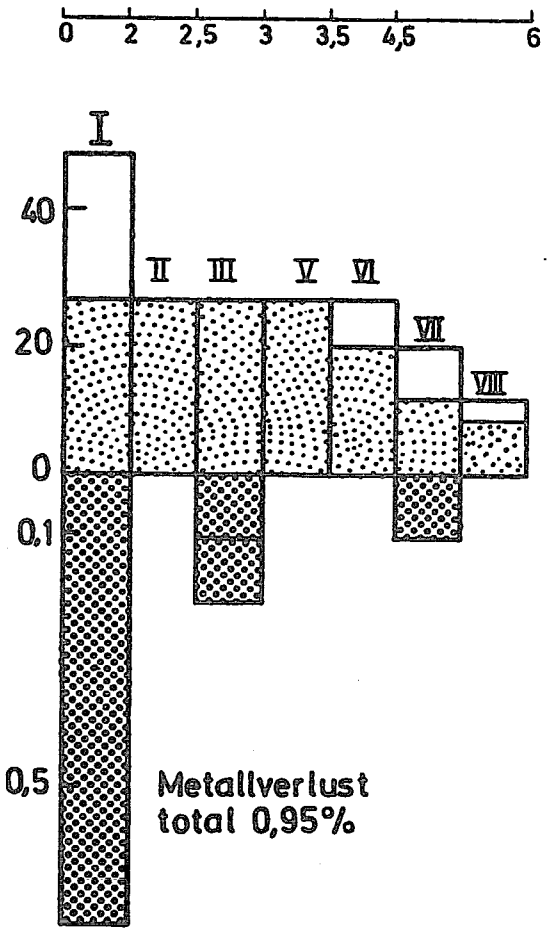
Figure 6:
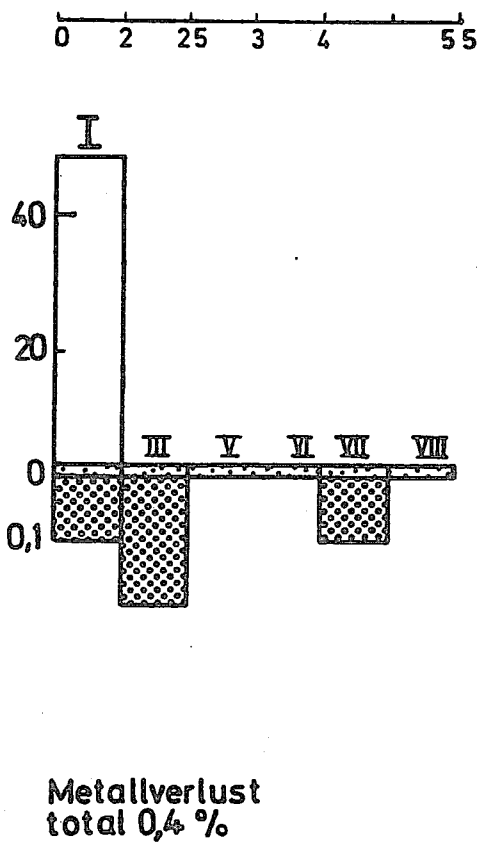

The details of the individual stages of the process, with respect to the removal of sodium and metal losses due to oxidation, are summarized in FIGS. 4–6. The sodium concentration in the aluminum melt (ppm) is indicated in the upper part of the diagram where the sodium concentration after the stage in the process is represented by the shaded columns and the concentration before the stage by the height of the non-shaded parts.

FIG. 4 shows the results obtained using current melt treatment methods involving a gas which combines with the sodium. The sequence of events in such a case is: pouring I, skimming off the dross in the furnace II, then alloying mixing and grain-refining III. After the gas treatment (IV) there follows: skimming off the dross (V), holding (VI) and casting (VIII). Typical of this method are the high metal losses (e.g. 1.3%), the large amount for time required (8 hours) and the attendant large expenditure on wages and energy.

FIG. 5 represents the current industrial practice in which the gas treatment (IV) in the furnace is replaced by melt filtration between the furnace and the casting unit. Since non-metallic inclusions can no longer be produced by the melt treatment and because of the subsequent filtering (VII), the holding time (VI) can be reduced. Characteristic of this process is that the time required is shorter (because the holding time is shorter and melt purification is combined with casting e.g. 6 hours instead of 8 hours), and also that less metal is lost (e.g. 0.95% instead of 1.3%). On the other hand the efficiency with respect to sodium removal is lower (only from 50 ppm to 8 ppm).

FIG. 6 refers to the process according to the invention. Because of the relatively slow rate at which the metal enters the furnace, no dross is formed. The skimming operation (II) is therefore omitted. It can be seen that the process is favorable with respect to all three criteria (shorter time required, lower metal loss of 0.4 wt %, and excellent efficiency in reducing the sodium content viz., from 50 ppm to <1 ppm). Depending on the production facilities the interval between removing the metal from the electrolytic cell and pouring it into the filter bed of the continuous filter unit amounts to between 10 and 120 minutes. The liquid metal cools to a temperature between 760° C. and 880° C. before entering the filter. This temperature is sufficiently high to reduce to a minimum reheating at the filter unit, and the associated energy costs.

The filter units which are chosen for the actual filter operation are usefully those which exhibit up to one cubic meter of active filter bed and permit a throughput of 7–20 tons of melt per hour per cubic meter of filter bed. This way the melt is in the filter unit for 1 to 6 minutes which results in the metal having an exit temperature of between 720° and 780° C. The whole cycle of furnace operations for the process according to the invention requires, as shown in FIG. 6, 5.5 hours.

In the case of the series of tests reported by way of example in table 1, the filter unit which was used, was round in cross section, had two chambers as in FIG. 2 and had an active volume of 0.15 $m^3$. The filter bed was made up various mixtures of granular material, petroleum carbon and coal tar pitch, the average particle size of which was 1 cm. The sodium concentration was determined by means of atomic absorbtion spectroscopy. The scavenging gas used was argon supplied from a steel gas cylinder. In this respect 0.3 $Nm^3$ gas/ton was regarded as normal and 0.5 $Nm^3$/ton as a large amount.

The unexpectedly favorable results from the process can be explained theoretically by the combination of at least three effects, the qualitative contribution of each effect however is largely unknown and can also be assumed to vary in the temperature range employed.

(1) It can be assumed with certainty that the carbon of the granular filter bed works as a surface catalyst for the transfer of sodium from the liquid to the gas phase, this catalytic effect being strongly temperature dependent. In a first phase the sodium is adsorbed on the surface of the carbon. In the next phase the carbon surface (with the adsorbed sodium on it) is covered by a gas bubble, the sodium desorbed and taken into the gas phase. In this third and presumably rate determining step, the enthalpies of desorption and vaporization are opposite in sign and therefore only the difference in their values must be provided to remove the sodium, whilst, without the postulated catalysis at the surface, the whole enthalpy of vaporization has to be supplied and, in addition, the surface tension of the molten aluminum has to be overcome. If flushing with a gas is omitted then it must be assumed that only the catalytic effect at the melt/granule interface is significant since it is only there the second stage could be conceived as proceeding.

(2) The temperature dependence of sodium removal can be explained metallurgically by the consideration that the partial pressure of sodium above an aluminum melt in which sodium is dissolved, increases with increasing temperature of the melt. Correspondingly, the rate of vaporization of sodium in a bubble of the flushing gas increases too (e.g. in the region of the melt surface) with increasing temperature of the metal. From this it is clear that from the point of view of eliminating sodium from the melt, it must be advantageous to choose for the filtration process a temperature which is as high as possible within the range which production allows.

(3) Also, it is not out of the question that the interaction of the sodium in the melt with the carbon leads to more or less quantitative and irreversible adsorption (chemisorption), or to a chemical reaction. In the case of the latter it is not known whether a salt-like carbide is formed by one of the reactions.

$$2Na + 2C \rightarrow Na_2C_2 \quad (1)$$

$$Na_2O + 3C \rightarrow Na_2C_2 + CO \quad (2)$$

or whether one of the rarely investigated metal-graphite compounds with a pronounced layer structure and one of the following compositions is formed viz., $NaC_8$ (brown), $NaC_{16}$ (grey) or $NaC_{60}$ (strongly graphitic (see K. Fredenhagen, Z. Anorg. Allg. Chem. 158, 1962, pp 249–263).

N. G. Schmahl, in: Ullman's Encyklopadie der technischen Chemie, 3 A, 1954, Vol. S, pp. 82 and 83;

R. Kiefer/F. Benesovsky, in: Kirk/Othmer Encyclopedia of Chemical Technology, 2nd ed. 1964, Vol. 4, pp. 71 to 73.

In the first case it is probable that the salt-like carbide $Na_2C_2$, which has a melting point of approx. 700° C. and a density of 1.575 g/$cm^3$ (R. C. Weast (ed), Handbook of Chemistry and Physics, 55. A. 1974/75, page B-137) at least rises in part to the surface of the melt (density of the aluminium melt is 2.1–2.5 g/$cm^3$, U.S. Pat. No. 3,281,238) and then enters the dross, either unchanged as carbide of as oxide after conversion by oxygen according to the equation:

$$Na_2C_2 + 5/2O_2 \rightarrow Na_2O + 2CO_2 \quad (3)$$

After cooling the dross, presumably hydrolysis occurs in accordance with the equation:

$$Na_2C_2 + 2H_2O \rightarrow 2NaOH + C_2H_2 \quad (4)$$

and the sodium is transformed to its hydroxide.

There is no doubt that the process according to equation (1) and the process by which metal-graphite compounds form are strongly temperature dependent, and therefore also from this point of view it appears to be favorable to choose the maximum possible production temperature for filtration of the melt.

(4) The quantitative contribution of each of the three effects described above and the temperature dependence of each on the overall efficiency of sodium removal are unknown. However, it may be assumed that with increasing temperature, in particular above 850° C., the relative contribution of the second effect, due to the difference in the vapor pressure curves for Na and Al, may increase at the expense of the other two effects.

What is claimed is:

1. An apparatus for lowering the sodium concentration of an aluminum melt comprising:

a filter chamber having a floor, an aluminum melt inlet and an aluminum melt outlet;

filter means provided in said chamber between said inlet and said outlet;

said filter means comprising a loosely packed bed of granular material comprising a carrier material and a chemically active carbon coating provided on the surface of said carrier material.

2. An apparatus according to claim 1 wherein the diameter of said granular material is from about 1 to 20 cm.

3. An apparatus according to claim 1 wherein the active volume of said granular material is from 0.05 to 0.3 cubic meters.

4. An apparatus according to claim 1 wherein said carrier material is selected from the group consisting of corundum, magnesite, zirconium oxide, zirconium silicate and basalt.

5. An apparatus according to claim 1 wherein said chemically active component is a carbon containing substance selected from the group consisting of petroleum carbon, ethylene coke, acetylene coke, graphite, bituminous coal, coal tar pitch and mixtures thereof.

6. An apparatus according to claim 1 wherein the density of said granular material is greater than the density of said aluminum melt.

7. An apparatus according to claim 6 wherein said carrier material is selected from the group consisting of corundum, magnesite, zirconium oxide, zirconium silicate and basalt.

8. An apparatus according to claim 7 further including inlet means for introducing inert gas into said granular material.

9. An apparatus according to claim 8 wherein said inert gas inlet means comprises a porous refractory brick in said floor of said chamber.

* * * * *